United States Patent [19]

Larsen

[11] Patent Number: 4,947,876

[45] Date of Patent: Aug. 14, 1990

[54] INSTANT NAIL POLISH KIT

[76] Inventor: Jean Larsen, 1539 Stonybrook Rd., Stonybrook, N.Y. 11790

[21] Appl. No.: 311,963

[22] Filed: Feb. 17, 1989

[51] Int. Cl.[5] ..... A45D 29/00

[52] U.S. Cl. ..... 132/73; 132/285

[58] Field of Search ..... 132/73, 285; 428/40, 428/41, 42

[56] References Cited

U.S. PATENT DOCUMENTS

| | | | |
|---|---|---|---|
| 2,234,657 | 3/1941 | Smaldone | 132/285 |
| 2,239,040 | 4/1941 | Holmes | 132/285 |
| 4,511,608 | 4/1985 | Ferraro | 132/73 |

FOREIGN PATENT DOCUMENTS

| | | | |
|---|---|---|---|
| 661624 | 11/1951 | United Kingdom | 132/73 |

*Primary Examiner*—John J. Wilson
*Assistant Examiner*—F. LaViola, Jr.
*Attorney, Agent, or Firm*—Richard L. Miller

[57] ABSTRACT

This nail polish kit is designed to provide color and protection to fingernails with little effort on the part of a user. Primarily, it consists of a very thin colored body with a rounded end for substantail mating engagement with the cuticle of a person's finger. There are a multiple number of these articles in a kit and each is adhered to two paper strips that are peeled away to apply the body to the fingernails of a person's hand. The opposite end of the colored body also extends past the front of the fingernail for using scissors to cut it to conform to the curved extending end of the fingernail.

6 Claims, 1 Drawing Sheet

FIG. 1
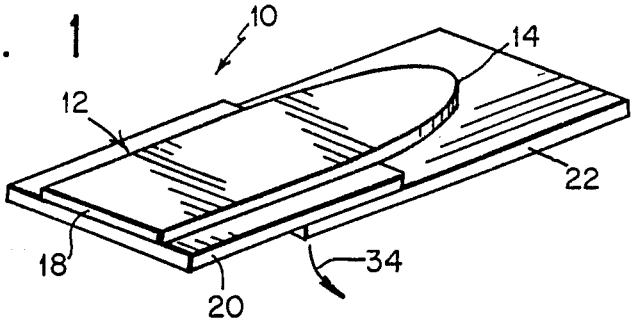
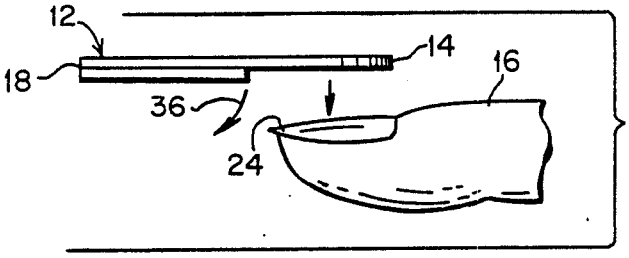
FIG. 2
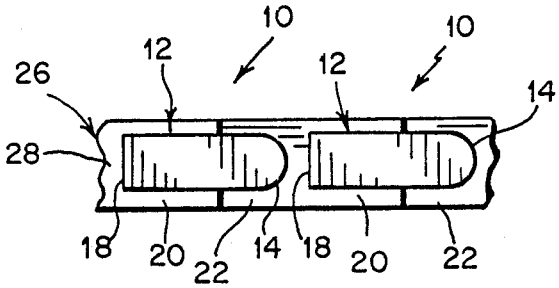
FIG. 3
FIG. 4
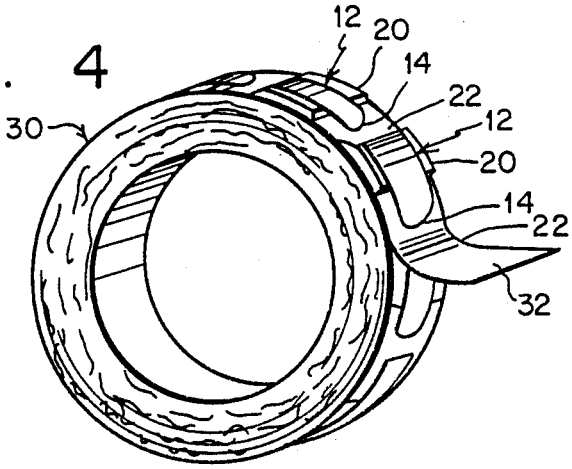

INSTANT NAIL POLISH KIT

BACKGROUND OF THE INVENTION

The instant invention relates generally to fingernail coloring, and more particularly, to an instant nail polish kit.

Numerous fingernail decorations have been provided in the prior art that are adapted to be applied to the nails of fingers. For example, U.S. Pat. Nos. 4,632,134 of Reid 4,627,453 of Isler, and 3,898,357 of Miller et al, all are illustrative of such prior art. While these units may be suitable for the particular purpose to which they address, they would not be as suitable for the purpose of the present invention as hereafter described.

SUMMARY OF THE INVENTION

A primary object of the present invention is to provide an instant nail polish kit that will overcome the shortcomings of the prior art devices.

Another object is to provide an instant nail polish kit that will be of such design, as to be a fast solution to applying nail colors.

An additional object is to provide an instant nail polish kit that will form a flexible, durable and shiny coat of color for application to each fingernail.

A further object is to provide an instant nail polish kit that is simple and easy to use.

A still further object is to provide an instant nail polish kit that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic perspective view of the instant invention;

FIG. 2 is a side elevational view showing the instant invention preparatory to application to a fingernail;

FIG. 3 is a plan view of the instant invention shown in tape form; and

FIG. 4 is a diagrammatic perspective view of the instant invention embodied on a roll of tape.

DETAILED DESCRIPTION OF THE PREFERRED EMBODIMENTS

Turning now descriptively to the drawings, in which like reference characters denote like elements throughout the several views, an article 10 is shown to include a very thin and colored flat body 12 having a rounded end 14 designed to substantially match and engage with the cuticle of a person's finger 16. The other end 18 is square and is flush with one end of a first paper strip 20 that adheres to a bottom surface of body 12, and a second paper strip 22 is provided that has one end overlapping an end of the first paper strip 20.

The rounded end 14 of the body 12 protrudes from the first paper strip 20, the overlapped area of the second paper strip 22 having a non-adhesive surface to overlap and adhesively adhere to the overlapped area of the second paper strip thereby locating the first and second strips together, the entire bottom surface of body 12, being provided with pressure sensitive adhesive of (not shown) for adhering to both the first strip 20, the second strip 22, and the fingernail 24.

In use, the second paper strip 22 is grasped by a user and peeled off first, as indicated by arrow 34 in FIG. 1. The thin colored body 12 is then applied to the fingernail 24 with the rounded end 14 towards the cuticle, as best seen in FIG. 2.

After the above, the first paper strip 20 is peeled off of the body 12, as indicated by arrow 36 in FIG. 2, and the square end of the body 12 is trimmed with a pair of scissors to conform with the rounded end of the fingernail 24.

Referring now to FIG. 3, each article 10 is adhered by adhesive (not shown) to a tape 26 having a non adhesive releasing surface 28.

In use, each article 10 is peeled off of tape 26 one at a time, and the same above mentioned procedure is employed to remove a body 12 therefrom and apply same to a fingernail 24.

Looking now at FIG. 4 of the drawing, a roll of tape 30 is provided as another embodiment and includes a plurality of adjacent articles 10 adhered thereto. In this instance a leader 32 is provided on the beginning end of the roll of tape 30 for easily removing the first article 10 therefrom.

In use, articles 10 are removed by peeling of of the roll of tape 30, and again the same above described procedure is employed to remove bodies 12 and attach them to fingernails 24.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An instant nail polish kit which comprises:

a plurality of thin and flat colored bodies, for adhering to fingernails and providing color for said fingernails, each body being provided with a rounded end for substantially mating engagement with a cuticle of a fingernail of a finger and an opposite, square end, and a bottom surface provided with an adhesive;

a first paper strip and a second paper strip adhered to said bodies, for mounting and protecting said bodies prior to employment on said fingernails;

the first and second paper strips each having first and second opposite end portions and being located together with a second end portion of the first strip overlapping a non-adhesive surface provided on a first end portion of the second strip;

said body being adhered to upper surfaces of said first and second paper strips with said square end aligned flush with the first end of said first paper strip and with said rounded end of said body protruding beyond the second end portion of the first paper strip to overlap and adhere to said surface of said second paper strip, the second end portion of the second paper strip protruding beyond the rounded end of said body and providing finger tab means for peeling said second paper strip off said rounded end of said body.

2. An instant nail polish kit as set forth in claim 1, wherein said second paper strip is peeled off of said rounded end and said first paper strip and said body is adhered to said fingernail, and said body is elongate, causing said opposite end that is square, to overhang said fingernail wherein said opposite end will be cut off by scissors to conform with an extending end of said fingernail.

3. An instant nail polish kit as set forth in claim 1, which forms a tape strip having a plurality of said bodies mounted to a surface of said tape strip by adhesive means that adheres said first paper strip and said second paper strip to a non adhesive surface of said tape strip.

4. An instant nail polish kit as set forth in claim 1, comprises a roll of tape having a plurality of said bodies mounted to a surface of said roll of tape by adhesive means that adheres said first paper strip and said second paper strip to a surface of said roll of tape.

5. An instant nail polish kit which comprises:

a plurality of thin and flat colored bodies, for adhering to fingernails and providing color for said fingernails, each body being provided with a rounded end for substantially mating engagement with a cuticle of a fingernail of a finger and an opposite, end that can be trimmed to conform with a free end of a fingernail of a finger, and a bottom surface provided with an adhesive;

first and second paper strips adhered to said bodies, for mounting and protecting said bodies prior to employment on said fingernails;

the first and second paper strips each having first and second opposite end portions and being located together with a second end portion of the first strip overlapping a non-adhesive surface provided on a first end portion of the second strip;

said body being adhered to surfaces of said first and second paper strips with said opposite end adhering to said first strip overlapping a non-adhesive surface provided on a first end portion of the second strip;

said body being adhered to surfaces of said first and second paper strips with said opposite end adhering to said first paper strip and with said rounded-end of said body protruding beyond the second end of the first paper strip and, overlapping and adhering to said surface of said second paper strip thereby securing the strips together, the second end portion of the second paper strip protruding beyond the rounded end of said body and providing finger tab means for peeling said second paper strip off said rounded end of said body;

successive pairs of said first and second paper strips mounting successive bodies being connected together by said second end portions of said second strips secured overlapping a first end portion of a first strip of a successive pair by respective successive bodies to form a continuous composite strip.

6. An instant nail polish kit formed as a coilable composite strip comprising;

pairs of paper strips;

thin, flat, elongate, colored bodies for adhering to fingernails and providing color therefor, each body provided with a rounded end for substantially mating engagement with a cuticle of a fingernail and an opposite end that can be trimmed to conform to a fingernail tip and a bottom surface provided with adhesive;

said pairs formed by a leading paper strip and a trailing paper strip, said trailing paper strip overlapping said leading paper strip;

each of said bodies being adhered to a respective pair, said rounded end being adhered to the leading paper strip and said opposite end adhered to the tailing paper strip;

said pairs successively connected whereby the leading paper strip of one pair forms the trailing paper strip of the next successive pair and the leading strip being separable from the composite strip by peeling the leading strip from the rounded end of the body thereby exposing said bottom adhesive surface for attachment to the fingernail and the opposite end subsequently separated from the trailing strip and trimmed to conform to the fingernail tip.

* * * * *